US009884215B2

(12) United States Patent
Chattaway et al.

(10) Patent No.: US 9,884,215 B2
(45) Date of Patent: Feb. 6, 2018

(54) FIRE SUPPRESSION SYSTEM ACTUATION APPARATUS AND SYSTEM

(71) Applicant: KIDDE TECHNOLOGIES, INC., Wilson, NC (US)

(72) Inventors: Adam Chattaway, Berkshire (GB); Harlan Hagge, Knightdale, NC (US)

(73) Assignee: KIDDE TECHNOLOGIES, INC., Wilson, NC (US)

( * ) Notice: Subject to any disclaimer, the term of this patent is extended or adjusted under 35 U.S.C. 154(b) by 0 days.

(21) Appl. No.: 15/173,071

(22) Filed: Jun. 3, 2016

(65) Prior Publication Data

US 2016/0279452 A1 Sep. 29, 2016

Related U.S. Application Data

(62) Division of application No. 14/261,312, filed on Apr. 24, 2014, now Pat. No. 9,381,389.

(51) Int. Cl.

| | |
|---|---|
| ***A62C 37/00*** | (2006.01) |
| ***A62C 35/10*** | (2006.01) |
| ***A62C 3/08*** | (2006.01) |
| ***A62C 37/48*** | (2006.01) |
| ***A62C 13/64*** | (2006.01) |
| ***A62C 13/76*** | (2006.01) |

(52) U.S. Cl.

CPC ..... *A62C 35/10* (2013.01); *A62C 3/08* (2013.01); *A62C 13/64* (2013.01); *A62C 13/76* (2013.01); *A62C 37/48* (2013.01)

(58) Field of Classification Search

CPC ..... A62C 13/64; A62C 35/10; A62C 37/40; A62C 37/48; A62C 37/10; A62C 37/04

USPC ..... 169/30, 71, 26, 29, 56, 58, 60, 61

See application file for complete search history.

(56) References Cited

U.S. PATENT DOCUMENTS

| | | | | |
|---|---|---|---|---|
| 3,800,878 A * | 4/1974 | Poitras | ..... | A62C 35/02 137/72 |
| 4,896,728 A * | 1/1990 | Wolff | ..... | A62C 37/10 169/26 |
| 8,584,767 B2 * | 11/2013 | Johnson | ..... | A62C 37/16 169/37 |
| 2011/0155265 A1 * | 6/2011 | Kikuchi | ..... | A62C 35/60 137/468 |

FOREIGN PATENT DOCUMENTS

| | | |
|---|---|---|
| EP | 0138195 | 4/1985 |
| FR | 2794984 | 12/2000 |

OTHER PUBLICATIONS

Extended European Search Report dated Aug. 28, 2015, European Patent Application No. 15164136.2.

* cited by examiner

*Primary Examiner* — Viet Le

(74) *Attorney, Agent, or Firm* — Snell & Wilmer L.L.P.

(57) ABSTRACT

A fire suppression system may comprise a shape memory actuation system. The shape memory actuation system may be configured as a retainer that retains a plug and/or a disk. The shape memory actuation system may be a shape memory plug that is configured to discharge from a vessel exhaust port. The shape memory actuation system may be deployable in response to an electrical stimulus (e.g., resistive heating causing the shape memory alloy to have a temperature exceeding a transition temperature).

6 Claims, 6 Drawing Sheets

FIRE SUPPRESSION SYSTEM ACTUATION APPARATUS AND SYSTEM

CROSS REFERENCE TO RELATED APPLICATIONS

This application is a division of application U.S. Ser. No. 14/261,312 filed Apr. 24, 2014 for FIRE SUPPRESSION SYSTEM ACTUATION APPARATUS AND SYSTEM.

FIELD

The present disclosure relates to fire suppression systems, and more specifically, to an actuation system for a fire suppression system that makes use of shape memory alloys.

BACKGROUND

Fire suppression systems have typically employed electro-explosive devices to actuate the fire suppression systems. For example, in a typical system, an electro-explosive device may be detonated causing a shockwave inside a discharge portion of the fire suppression system. The detonation and/or shockwave may rupture and/or deform the disk that restrains the fire suppression agent. The pressure of the fire suppression agent may further rupture and/or deform the disk, allowing the fire suppression agent to be discharged into an aircraft structure.

SUMMARY

In various embodiments, a fire suppression system may comprise a vessel, a disk, a plug, a retainer, and a flow control element. The vessel may be configured to contain a fire suppression agent. The disk may be configured to seal the vessel and retain the fire suppression agent. The plug may be configured to support and retain the disk. The retainer may be configured to constrain the plug. The retainer may also be configured to non-destructively change shape. The exhaust port may be configured to direct the fire suppression agent in response to the fire suppression system being activated.

In various embodiments, a fire suppression pressure vessel may comprise a vessel, a disk, and a shape memory plug. The vessel may be configured to hold pressurized fire suppression agent. The disk may be configured to hermetically seal an exhaust port of the vessel. The shape memory plug may be installable in the exhaust port. The shape memory plug may also be configured to support the disk.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the inventions, it should be understood that other embodiments may be realized and that logical changes and adaptations in design and construction may be made in accordance with this invention and the teachings herein. Thus, the detailed description herein is presented for purposes of illustration only and not of limitation. The scope of the invention is defined by the appended claims. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts but not necessarily to denote the same or different materials.

Figure 1:
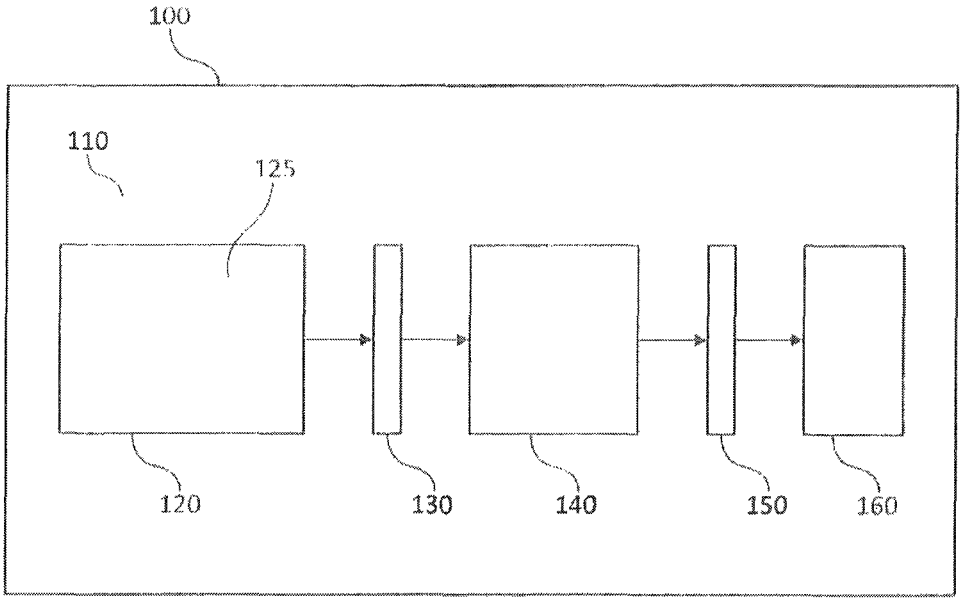
FIG. 1 is a block diagram of fire suppression system components, in accordance with various embodiments.

In various embodiments and with reference to FIG. 1, aircraft structure 100 may comprise a fire extinguishing system 110. Fire extinguishing system 110 may be configured to provide a fire suppression agent 125 to aircraft structure 100. In this regard, fire extinguishing system 110 may be configured to disperse fire suppression agent 125 into aircraft structure 100 in response to detecting heat, smoke, a flame, particulates, and/or any other suitable indicator of a fire in aircraft structure 100.

In various embodiments, fire extinguishing system 110 may comprise a vessel 120 (e.g., bottle, a pressure vessel, fire suppression agent storage tank, and/or the like), a disk 130, a plug 140, a retainer 150, and an exhaust port 160 (e.g., a flow control mechanism, nozzle, orifice, and/or the like). Vessel 120 may comprise and/or contain fire suppression agent 125 (e.g., an inert gases and/or chemical agents used to extinguish fire such as, for example, HALON®). Disk 130 may be configured to partially retain and/or restrain fire suppression agent 125 in vessel 120. In this regard, fire suppression agent 125 may be under pressure in vessel 120. Plug 140 may be configured to block the opening of vessel 120 and partially retain and/or restrain disk 130. Retainer 150 may be configured to restrain and/or retain plug 140 and/or fire suppression agent 125. Exhaust port 160 may be configured to conduct fire suppression agent 125 from vessel 120 into aircraft structure 100.

In various embodiments, retainer 150 may be comprised of a shape memory material. A shape memory material may be any material that is configured to change shape and/or phase in response to a predetermined stimulus (e.g., heat, electrical stimulation, and/or the like). For example, the shape memory material may be configured with a transition temperature. In response to increasing the heat of retainer 150 and/or the shape memory material past a transition temperature, retainer 150 and/or the shape memory alloy may change shape and/or phase. In this regard, retainer 150 and/or the shape memory alloy may reversibly change shape and/or phase. Retainer 150 may be any suitable shape memory alloy such as for example, Nitinol (Nickel-Titanium alloys), and the like.

Figure 2:
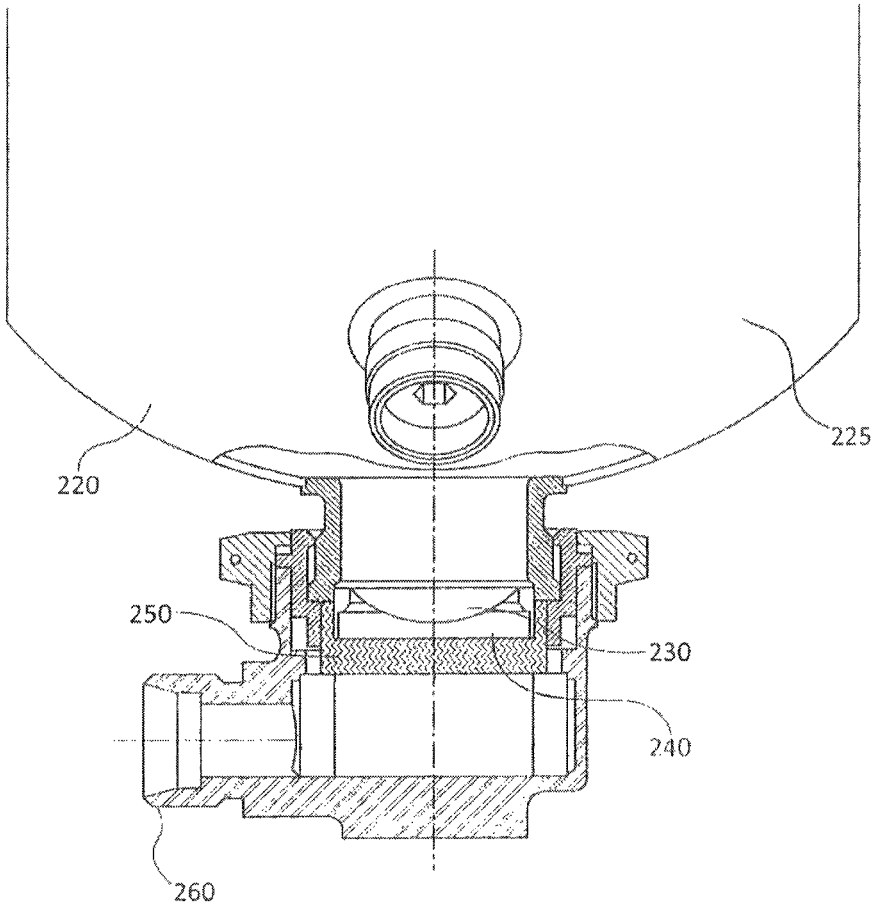
FIG. 2 illustrates a portion of a fire suppression system including a discharge head, in accordance with various embodiments.

In various embodiments and with reference to FIG. 2, retainer 250 may also be configured to restrain, retain, and/or hold plug 240 in a position adjacent to disk 230. Disk 230 may be hermetically sealed to vessel 220. In this regard, disk 230 and the corresponding hermetic seal may reduce, minimize, and/or eliminate leakage of fire suppression agent 225 from vessel 220. Disk 230 may be designed to rupture at a pressure less than the internal pressure of fire suppression agent 225 in vessel 220.

In various embodiments and in operation, retainer 250 may be actuated in response to detection of a fire event. The heating of retainer 250 past the transition temperature may cause retainer 250 to change shape, releasing plug 240. The internal pressure of fire suppression agent 225 may cause disk 230 to rupture. Fire suppression agent 225 may further push plug 240 from the mouth of vessel 220 releasing fire suppression agent 225 to exhaust port 260.

Figure 3A:
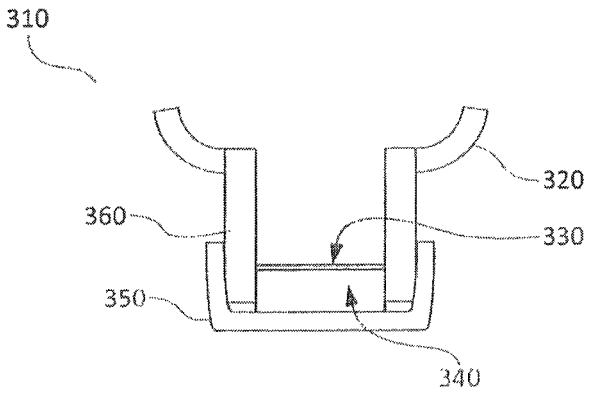
FIG. 3A illustrates a portion of a fire suppression system comprising a first shape memory alloy actuation system in a stowed configuration, in accordance with various embodiments.
Figure 3B:
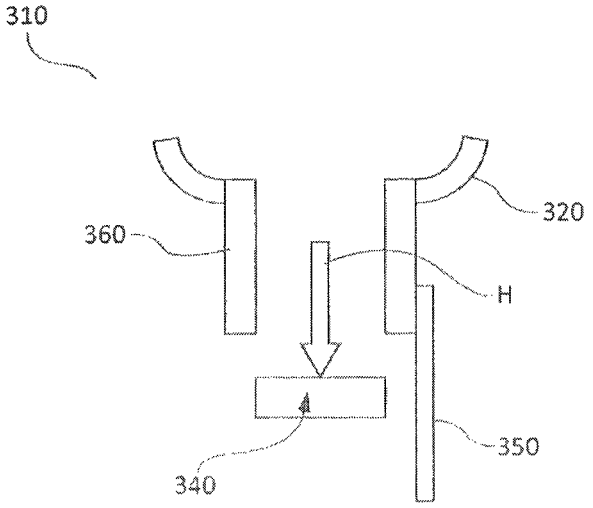
FIG. 3B illustrates a portion of a fire suppression system comprising a first shape memory alloy actuation system in a deployed configuration, in accordance with various embodiments.

In various embodiments and with reference to FIGS. 3A and 3B, in a stowed position as shown in FIG. 3A, retainer 350 may be configured to contain, restrain, and/or otherwise hold plug 340 and/or disk 330 in a position to retain fire suppression agent in vessel 320. For example, retainer 350 may be configured to mate to an outer diameter of exhaust port 360. Fire suppression system 310 may be configured to transition from a stowed position as shown in FIG. 3A to a deployed position as shown in FIG. 3B in response to a fire being detected. The transition from the stowed position to the deployed position may include retainer 350 changing shape in response to a stimulus, causing at least a portion of retainer 350 to release from exhaust port 360.

In various embodiments, shape change and/or actuation of retainer 350 between a first configuration and a second configuration may be electrical. In this regard, actuation of retainer 350 may be commanded via ohmic heating and/or electrical resistance heating of retainer 350. This may cause the temperature of retainer 350 to increase past the transition temperature (e.g., the temperature at which the shape memory alloy transitions, changes phase, and/or changes shape). In this regard, retainer 350 and/or the shape memory alloy used to make retainer 350 may be designed to transition at a temperature corresponding to a desired thermal relief temperature so that the pressure is safely relieved from vessel 320 in the event of an extreme high temperature environment. Moreover, retainer 350 and/or the shape memory alloy used to make retainer 350 may be designed and/or may vary depending on the specific application where the fire extinguishing system is deployed.

Figure 4A:
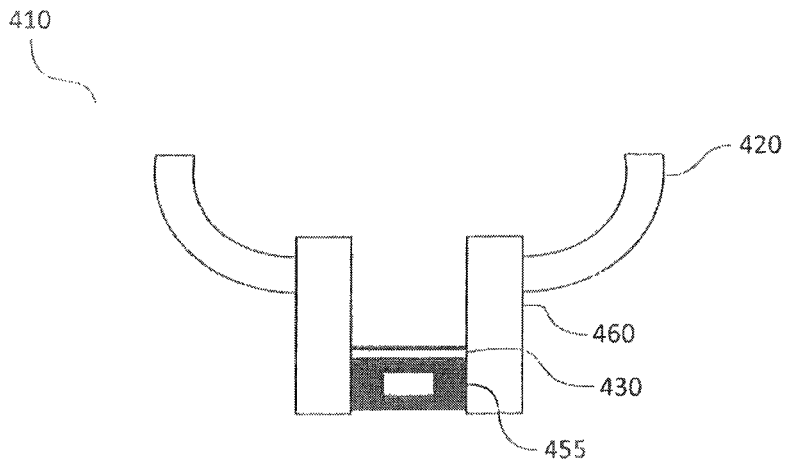
FIG. 4A illustrates a portion of a fire suppression system comprising a second shape memory alloy actuation system in a stowed configuration, in accordance with various embodiments.
Figure 4B:
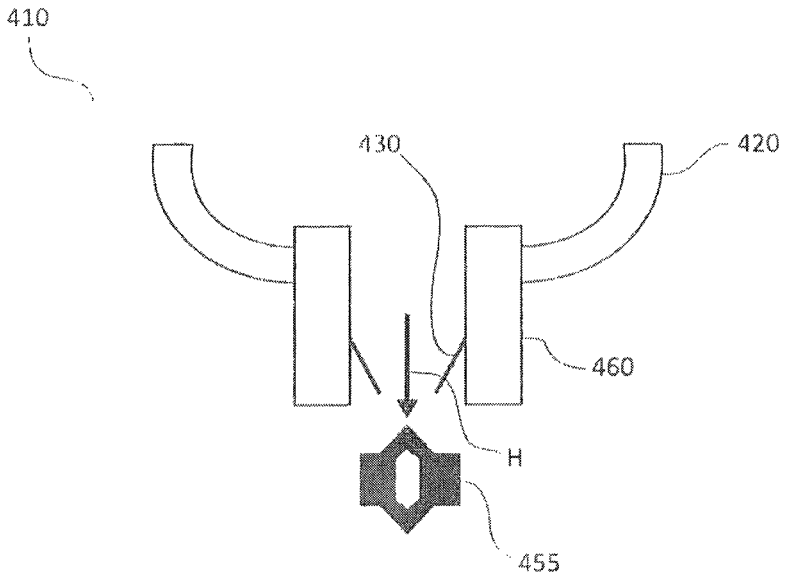
FIG. 4B illustrates a portion of a fire suppression system comprising a second shape memory alloy actuation system in a deployed configuration, in accordance with various embodiments.

In various embodiments and with reference to FIGS. 4A and 4B, fire suppression system 410 may be sealed by any suitable shape memory structure. More specifically, disk 430 may be hermetically sealed to vessel 420. Disk 430 may be retained and/or supported by any suitable shape memory structure. For example, where fire extinguishing system 410 is in a stowed position as shown in FIG. 4A, disk 430 may be supported by shape memory plug 455. Shape memory plug 455 may be installed in a portion of exhaust port 460. In response to fire extinguishing system 410 being commanded to a deployed position, shape memory plug 455 may change shape (e.g., contract) and discharge from exhaust port 460. In response to discharge of shape memory plug 455, disk 430 may rupture, allowing a fire suppression agent to discharge from vessel 420.

Figure 5A:
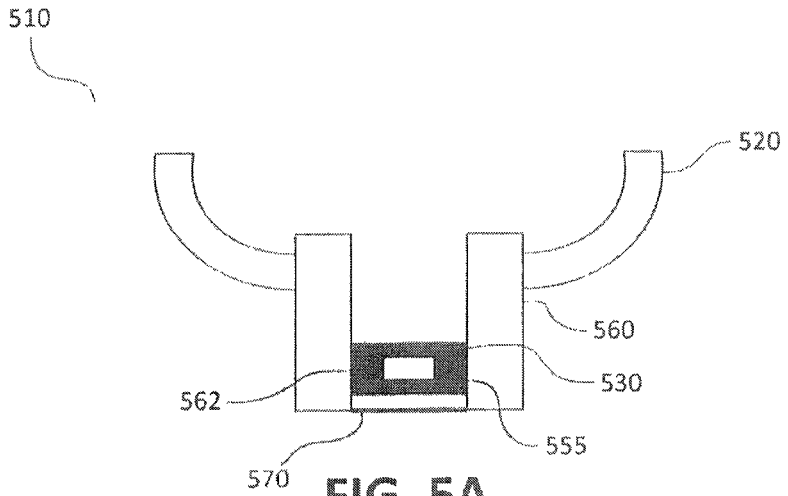
FIG. 5A illustrates a portion of a fire suppression system comprising a third shape memory alloy actuation system in a stowed configuration, in accordance with various embodiments.
Figure 5B:
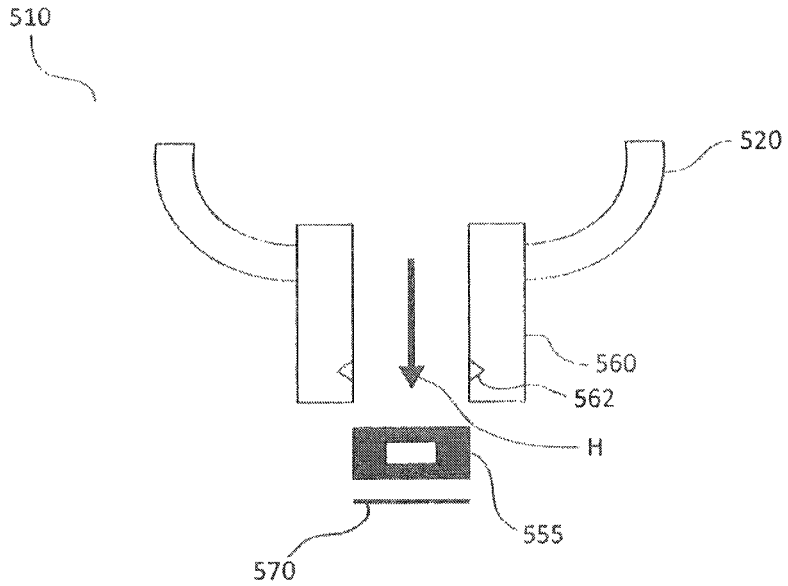
FIG. 5B illustrates a portion of a fire suppression system comprising a third shape memory alloy actuation system in a deployed configuration, in accordance with various embodiments.

In various embodiments and with reference to FIGS. 5A and 5B, fire extinguishing system 510 may comprise a clip 570 that is configured to retain plug 555 in exhaust port 560. Clip 570 may be a shape memory material. Clip 570 may be retained in groove 562, which may be formed in exhaust port 560. In response to clip 570 be exposed to a trigger temperature, clip 570 may change shape and may be discharged from exhaust port 560. In this regard, clip 570 may shrink or otherwise change shape such that it is not retained within groove 562. This may also allow plug 555 to be discharged from exhaust port 560.

Figure 6A:
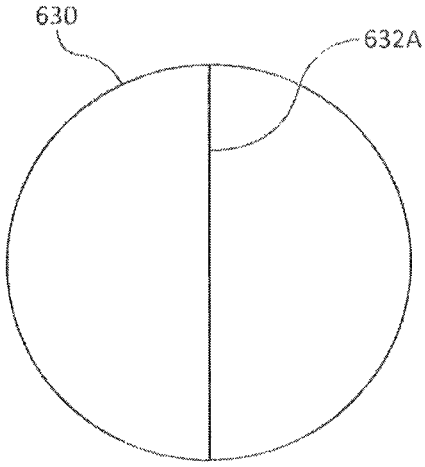
FIGS. 6A-6B illustrate a retaining disk comprising design rupture patterns, in accordance with various embodiments.
Figure 6B:
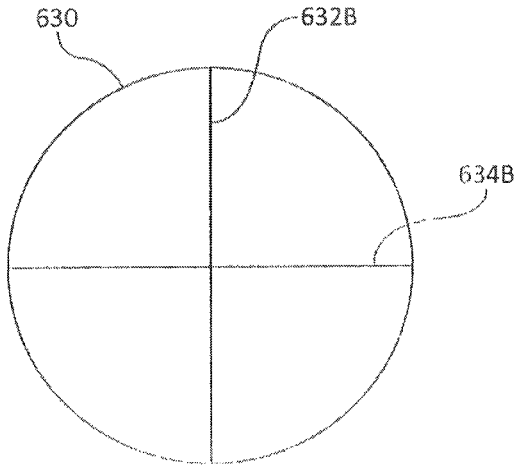

In various embodiments and with reference to FIGS. 6A and 6B, disk 630 may comprise and/or be designed to rupture in a specific fashion. For example, disk 630 may comprise one or more stress concentrations, scores, and/or design rupture pattern 632A. Moreover, disk 630 may comprise multiple design rupture points including, for example, design rupture pattern 632B and design rupture pattern 634B. In this regard, disk 530 may be configured to rupture in a specific way to provide sufficient flow, and/or activation in response to the retainer and/or plug being discharged from the bottle of a fire extinguishing system. A disk having a configuration of stress concentrations, scores, and/or design rupture pattern may be referred to as having a "designed rupture pattern."

In various embodiments, the fire extinguishing systems described herein may be deployed in any suitable aircraft structure. For example, the fire extinguishing systems described herein may be deployed and/or used in cargo bays, engine nacelles, in auxiliary power unit bays, as part of any suitable fire protection system in an aircraft, structure, and/or vehicle.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the inventions. The scope of the inventions is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A fire suppression pressure vessel, comprising:

a vessel configured to hold pressurized fire suppression agent;

a disk capable of rupturing in response to being exposed to the pressurized fire suppression agent and configured to hermetically seal an exhaust port of the vessel; and a shape memory plug installable at the exhaust port, wherein the shape memory plug is configured to support the disk to reduce the likelihood of rupture of the disk, and configured to change shape in response to a change in temperature, causing the shape memory plug to cease supporting the disk such that the pressurized fire suppression agent ruptures the disk in response to the shape memory plug ceasing to support the disk.

2. The fire suppression pressure vessel of claim 1, wherein the shape memory plug is configured to contract and discharge from the exhaust port in response to activation of a fire suppression system.

3. The fire suppression pressure vessel of claim 1, wherein the disk comprises a design rupture pattern.

4. The fire suppression pressure vessel of claim 1, wherein the shape memory plug is configured to be installed within the exhaust port.

5. The fire suppression pressure vessel of claim 1, wherein the shape memory plug is configured to contract in response to at least one of an electrical stimulus or a temperature condition.

6. The fire suppression pressure vessel of claim 1, wherein the shape memory plug is configured to change shape in response to at least one of an electrical stimulus or a temperature condition.

* * * * *